US005581968A

United States Patent [19]

Laurie et al.

[11] Patent Number: 5,581,968

[45] Date of Patent: Dec. 10, 1996

[54] SEAM CONNECTOR FOR SIDING PANELS

[75] Inventors: Gregg A. Laurie, Bloomsburg, Pa.; Larry A. Demaree, Bloomfield, Mich.

[73] Assignee: Composite Products, Inc., Hazelton, Pa.

[21] Appl. No.: 496,106

[22] Filed: Jun. 28, 1995

[51] Int. Cl.[6] ..... E04D 1/00

[52] U.S. Cl. ..... 52/538; 52/536; 52/539; 52/542

[58] Field of Search ..... 52/535, 536, 538, 52/539, 542

[56] References Cited

U.S. PATENT DOCUMENTS

| | | | |
|---|---|---|---|
| 719,514 | 2/1903 | Schall | 52/538 |
| 973,946 | 10/1910 | Lindau | 52/538 |
| 2,004,198 | 6/1935 | Fall . | |
| 2,264,546 | 12/1941 | Ochs . | |
| 2,482,835 | 9/1949 | Bremer . | |
| 3,058,265 | 10/1962 | Lapensohn . | |
| 3,412,517 | 11/1968 | Ellis et al. . | |
| 3,605,369 | 9/1971 | Merrill et al. . | |
| 3,862,532 | 1/1975 | Makkos | 52/536 X |
| 4,651,492 | 3/1987 | Mendez . | |
| 4,729,202 | 3/1988 | Ferland | 52/536 X |
| 4,731,969 | 3/1988 | Baker et al. | 52/536 |
| 4,890,432 | 1/1990 | Sheperd . | |
| 5,131,200 | 7/1992 | McKinnon | 52/536 |
| 5,174,092 | 12/1992 | Naden . | |

*Primary Examiner*—Wynn E. Wood

*Attorney, Agent, or Firm*—Edgar A. Zarins; Malcolm L. Sutherland

[57] ABSTRACT

A connector assembly for siding panels to form a self-flashing, leakproof seam between the ends of the siding panels. The connector assembly includes first and second connectors each attachable to an end of a siding panel. Upon securement of the connectors to the siding panel, the siding may be applied to the building with the connectors overlapping preventing longitudinal separation. The vertical channels of the connectors allows sliding engagement of the siding.

7 Claims, 2 Drawing Sheets

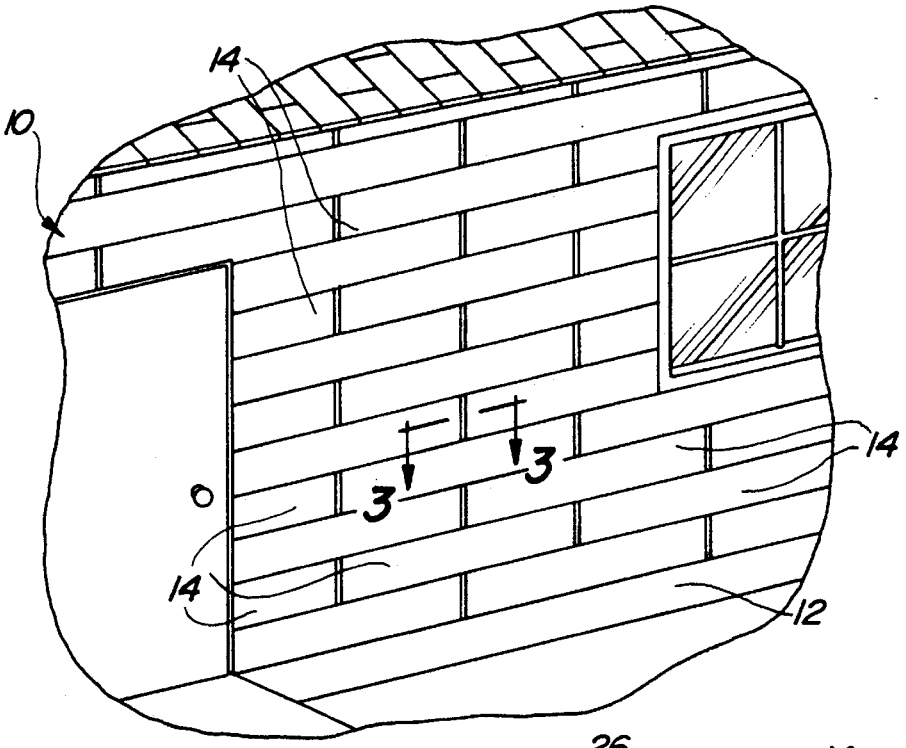
Fig - 1
Fig - 2
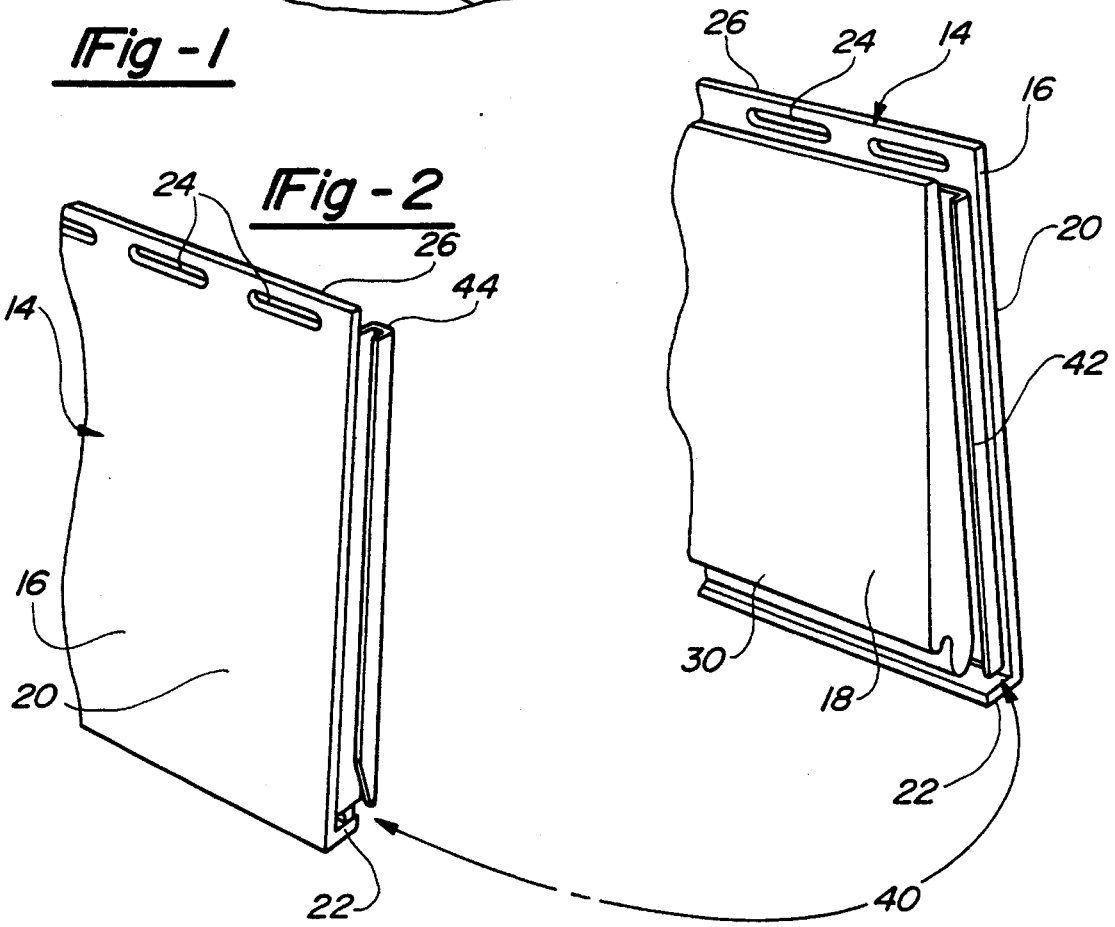

SEAM CONNECTOR FOR SIDING PANELS

BACKGROUND OF THE INVENTION

I. Field of the Invention

This invention relates to means of connecting contiguous sections of siding and, in particular, to a connector assembly which may be mounted to siding boards to prevent lateral separation of the boards while forming a leakproof seam.

II. Description of the Prior Art

Siding sections are typically applied in elongated panels having ends abutting or overlapping forming seams therebetween. In the case of hollow siding such as vinyl or aluminum the subsequent panel simply overlaps the previously mounted panel to prevent fluid leakage behind the siding. However, in insulated or solid siding panels such overlapping is not possible and therefore the siding sections are mounted end-to-end creating a gap. Furthermore, the seam gap can vary in response to weather conditions causing separation of the siding.

Connector assemblies have been developed which prevent separation of shingles and siding panels. Channel members integrally formed with the panel are widely used on rigid shingles. However, since shingles are relatively short they rarely need to be cut and therefore the integral connector remains with the panel. Siding sections are provided in nominal lengths of ten feet or larger. Frequently, because of irregularities in the building facade, siding sections must be cut to length. A connector integrally formed as part of the siding panel would also be cut away leaving no connector. Additionally, integral connectors must be formed of the same material as the siding panel which is not always desirable.

SUMMARY OF THE PRESENT INVENTION

The present invention overcomes the disadvantages of the prior known connectors by providing first and second connector components which are secured to the ends of contiguous siding panels to form, upon interconnection, a self-flashing, leak proof, concealed butt joint connector.

The preferred embodiment of the present invention comprises first and second connectors adapted to be attached to the butt ends of siding sections. The connectors are preferably stamped metal channel members including a male connector and a female connector. Each connector has a flange plate to be secured to the siding member. Disposed perpendicular to the flange plate of the male connector is a connector flange which widens in depth from top to bottom to accommodate the angle of the siding member. The female connector includes a channel member extending from a connector flange perpendicular to the flange plate. As with the male connector, the connector flange widens in depth such that the channel member is deeper at one end than the other, again to accommodate the angle of the siding.

As the siding is mounted to the building, one end of each siding panel will be provided with a male connector and the other end a female connector. The male connector of a subsequent panel is slid into the female connector of a preceding panel as contiguous panels are mounted on the building. The connector flange of the male connector engages the channel member preventing lateral separation of the siding members. While facilitating expansion and contraction, the channel member forms a flashing for the seam directing water downwardly along the exterior of the siding.

Since the connectors are disposed beneath the outer surface of the siding the connector is concealed from view.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which:

FIG. 1 is a partial perspective view of a building incorporating a plurality of building panels embodying the connector assembly of the present invention;

FIG. 2 is an exploded view of a pair of contiguous panels with the connector assembly.

DETAILED DESCRIPTION OF A PREFERRED EMBODIMENT OF THE PRESENT INVENTION

Figure 3:
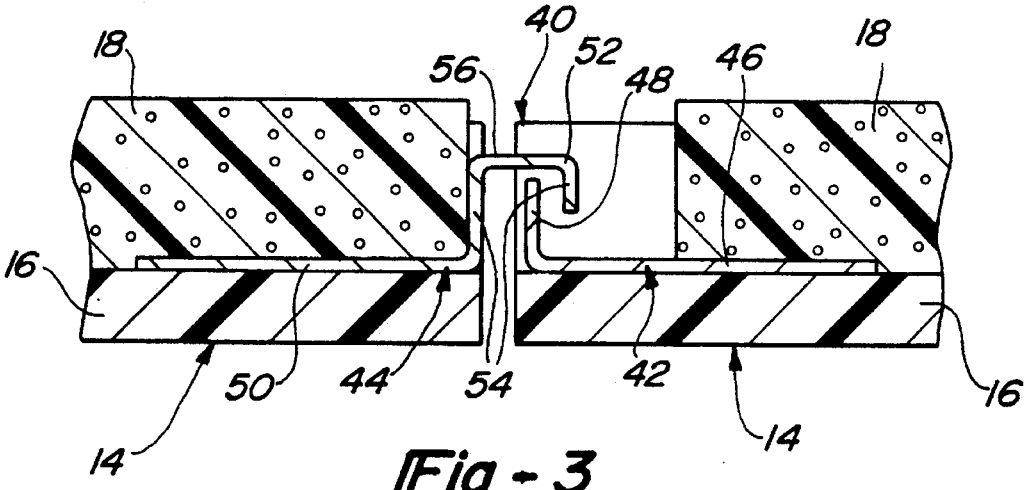
FIG. 3 is a cross-sectional view taken along lines 3—3 of FIG. 1.

Referring first to FIG. 1, there is shown a building 10 having an exterior wall 12 which must be weatherproofed to withstand moisture and temperature variations in order to protect the interior of the building 10. In accordance with the present invention, a plurality of building panels 14 are mounted to the wall 12 in interlocking fashion to protect against the elements. The panels 14 are mounted to the wall 12 utilizing common fasteners in an overlapping arrangement to direct moisture down the wall 12 and away from the buildings 10. A variety of well-known building panels 14 may be employed including vinyl siding, aluminum siding or wood fiber shingles. For purposes of describing the present invention, a building panel 14 of composite materials is shown and described.

Referring now to FIGS. 2 and 3, the composite building panel 14 includes an outer rigid shell 16 and an insulating substrate 18. The rigid shell 16 provides a shield against the elements and includes a front panel 20 and a bottom flange 22 so that the panel 14 can be mounted at an angle to facilitate interlocking fastening and to direct moisture away from the building 10. A plurality of fastener apertures 24 are formed along an upper edge 26 of the shell 16 to mount the panel 14. The substrate 18 is used as an insulation against temperature variations and preferably is wedge-shaped to complement the angled mounted of the panel 14. An interlock groove 28 along a lower edge 30 of the substrate 18 facilitates connection with the building panel 14 mounted immediately below.

While vertical interlock between building panels 14 is commonplace as contiguous rows of the panels 14 are mounted to the building, connection between horizontally contiguous panels 14 is more problematic. In many applications, the panels are simply overlapped a distance believed to be sufficient to prevent moisture from flowing behind the panels. This results in a considerable waste of material in siding the building and does not ensure weatherproofing. In an effort to lower material costs, the panels could be mounted in contiguous relation. Although initially mounted with no gap, the normal thermal expansion and contraction of the material could create a substantial gap allowing moisture to flow behind the panels.

The connector assembly of the present invention overcomes these disadvantages by allowing contiguous mounting of the building panels 14 while forming a self-flashing, leakproof, concealed butt-joint connector 40. The connector assembly 40 comprises first 42 and second 44 connectors each mounted to a respective building panel 14 adapted to be mounted in side-by-side relation.

The first connector 42 includes a flange plate 46 and a connector flange 48 integrally formed perpendicular to the flange plate 46. The flange plate 46 is used to mount the first connector 41 to the panel 14. Preferably, the flange plate 46 is inserted between the shell 16 and substrate 18 as shown in FIG. 3. As a result, the connector flange 48 extends rearwardly perpendicular to the plane of the panel 14.

The second connector 44 includes a flange plate 50 and a channel flange 52 integrally formed perpendicular to the flange plate 50. The flange plate 50 of the second connector 44 is similarly inserted between the shell 16 and substrate 18 to attach the second connector 44 to the building panel 14. The channel flange 52 has a substantially U-shaped cross-sectional configuration as shown in FIG. 3 in order to matingly receive the connector flange 48 of the first connector 42. The channel flange 52 inner and outer side walls 54 disposed perpendicular to the flange plate 50 and the plane of the panel 14 and an interior end wall 56 extending between the side walls 54. The channel flange 52 operates to direct moisture downwardly along the building panels 14.

In order to accommodate the wedged or tapered configuration of the building panel 14, both the first and second connectors 42 and 44, specifically the connector flange 48 and channel flange 52 respectively, have a greater depth at their lower end than at the upper end.

Application of the present invention provides a concealed, leakproof seam connector for abutting edges of building panels 14. The panels 14 may be supplied with the connectors 42 and 44 already mounted to opposite ends of the panels 14 or the connector assembly 40 may be installed as each panel 14 is fitted to the building 10. A first panel having the second connector 44 attached to an end is secured to the building 10 as part of a row of panels 14. A second panel having the firs connector 42 can then be mounted to the building 10 contiguous to the first panel by inserting the connector flange 48 into the channel flange 52. Once the panels 14 are mounted the seam connector 40 facilitates thermal expansion without permitting separation of the connector 40. Despite the expansion, the channel flange 52 prevents moisture from flowing behind the seams. The staggered mounting of the seams as shown in FIG. 1, ensures the moisture is directed form the channel flange 52 over the outer surface of the panel 14 beneath the seam.

The foregoing detailed description has been given for clearness of understanding only and no unnecessary limitations should be understood therefrom as some modifications will be obvious to those skilled in the art without departing from the scope and spirit of the appended claims.

What is claimed is:

1. A connector assembly for connecting contiguous panels of building siding, the siding including first and second panels having adjacent ends forming a seam therebetween, said connector assembly comprising:

a first connector selectively attachable to the end of the first siding panel, said first connector having a flange plate attachable to the first siding panel and a connector flange perpendicular to said flange plate such that said connector flange is disposed perpendicular to a plane of the first siding panel upon attachment thereto; and a second connector selectively attachable to the end of the second panel, said second connector having a flange plate attachable to the second siding panel and a channel flange perpendicular to said flange plate such that said channel flange is disposed perpendicular to a plane of the second siding panel upon attachment thereto, said channel flange including a first side wall integral with said flange plate, a second side wall and an end wall extending between said first and second side walls forming a substantially U-shaped channel;

said channel flange of said second connector receiving said connector flange of said first connector preventing lateral separation of the first and second siding panels.

2. The connector assembly as defined in claim 1 wherein said first and second connectors have a length substantially equal to the height of the siding panels.

3. The connector assembly as defined in claim 2 wherein said connector flange of said first connector narrows over said length of said first connector such that said connector flange has a greater depth at a lower end than of an upper end.

4. The connector assembly as defined in claim 3 wherein said inner side wall of said channel flange narrows over said length of said second connector such that said channel flange has a greater depth at a lower end than at an upper end.

5. In a siding system for a building including contiguous panels of building siding, the siding including first and second panels having adjacent ends forming a seam therebetween, the improvements comprising:

a first connector selectively attachable to the end of the first siding panel, said first connector having a flange plate attachable to the first siding panel and a connector flange perpendicular to said flange plate, said connector flange narrowing over the length of said first connector; and a second connector selectively attachable to the end of the second siding panel, said second connector having a flange plate attachable to the second siding panel and a channel flange perpendicular to said flange plate, said channel flange including a first side wall integral with said flange plate, a second side wall spaced apart from said first side wall and an end wall extending between said first and second side walls forming a substantially U-shaped channel, said first side wall of said channel flange narrowing over the length of said second connector;

said channel flange of said second connector receiving said connector flange of said first connector preventing lateral separation of the first and second siding panels, said first and second connectors cooperating to form a tapered connection between the siding panels.

6. The connector assembly as defined in claim 5 wherein said connector flange of said first connector has a greater depth at a lower end than at an upper end.

7. The connector assembly as defined in claim 6 wherein said channel flange of said second connector has a greater depth at a lower end than at an upper end.

* * * * *